US007360803B2

(12) United States Patent
Parent et al.

(10) Patent No.: US 7,360,803 B2
(45) Date of Patent: Apr. 22, 2008

(54) LOCK ASSEMBLY

(75) Inventors: Pascal Parent, Brossard (CA); Daniel Filion, Prevost (CA)

(73) Assignee: WABTEC Holding Corp., Wilmerding, PA (US)

( * ) Notice: Subject to any disclaimer, the term of this patent is extended or adjusted under 35 U.S.C. 154(b) by 186 days.

(21) Appl. No.: 11/080,593

(22) Filed: Mar. 15, 2005

(65) Prior Publication Data

US 2006/0208502 A1 Sep. 21, 2006

(51) Int. Cl.
*E05C 3/06* (2006.01)

(52) U.S. Cl. ..... 292/216; 292/117

(58) Field of Classification Search ..... 292/117, 292/201, 216
See application file for complete search history.

(56) References Cited

U.S. PATENT DOCUMENTS 5,613,716 A * 3/1997 Cafferty ..... 292/216
5,938,252 A * 8/1999 Uemura et al. ..... 292/201
6,027,148 A * 2/2000 Shoemaker ..... 292/216
6,139,073 A 10/2000 Heffner et al.
6,701,671 B1 * 3/2004 Fukumoto et al. ..... 49/280

* cited by examiner

*Primary Examiner*—Gary Estremsky
(74) *Attorney, Agent, or Firm*—James Ray & Assoc.

(57) ABSTRACT

A lock mechanism for locking and unlocking a door in a passenger vehicle includes a lock cam pivotally connected to a base member. The lock cam has a slot for engaging a lock pin attached to the door. A pivotally connected lock lever engages the lock cam for biasing it and the door lock element in the locked position. An actuator is attached to the base member and connected to the lock lever for releasing the lock lever from engagement with the lock cam enabling the door to unlock. The actuator is connectable with a door control system for receiving a release signal. A manual release is connected to the lock mechanism to manually release the lock cam from engagement with the lock lever. A toggle mechanism biases the manual release in the unlock position and returns it into the lock position. A second pair of lock cam and lock lever may be provided for locking and unlocking a second door in the passenger vehicle.

13 Claims, 6 Drawing Sheets

LOCK ASSEMBLY

CROSS-REFERENCE TO RELATED APPLICATIONS

This application is related to U.S. Pat. No. 6,139,073 entitled "Lock Assembly" and owned by the assignee of the present invention. The teaching of U.S. Pat. No. 6,139,073 is incorporated into this document by reference thereto.

FIELD OF THE INVENTION

The present invention relates, in general, to lock mechanisms for locking a movable object and, more particularly, this invention relates to lock mechanisms for locking a door of a vehicle and, yet more particularly, the instant invention relates to a lock mechanism for locking at least one door of a passenger transit vehicle.

BACKGROUND OF THE INVENTION

The following background information is provided to assist the reader in understanding the environment in which the invention will typically be used. The terms used herein are not intended to be limited to any particular narrow interpretation unless specifically stated otherwise in this document.

The present invention will be discussed in an application involving a movable door for a passenger transit vehicle, as those skilled in the art will readily understand its use in other applications.

Lock mechanisms for selectively locking and unlocking a single door or a pair of doors in a transit vehicle are well known in the art. Reliability of such lock mechanisms have implications on overall operation and safety of the passenger vehicle as well as ability for passengers to ingress and egress such passenger vehicle.

The lock mechanism must positively and reliably engage the door to prevent unwanted opening thereof during vehicle motion so not to endanger the passengers. The lock mechanism must also reliably disengage from such door enabling a controlled opening thereof at the station for passenger ingress and egress. Failure of the lock mechanism to reliably disengage from the door will result in passenger inconvenience and operational schedule delays. Additionally, the lock mechanism must be provided with capabilities enabling a passenger to manually unlock and open the door, especially during an emergency situation.

Reliability of the lock mechanism operation is generally associated with the quantity of individual components with a smaller number of components being advantageous for a more reliable operation. Such smaller number of components is also desirable to simplify assembly, installation and adjustment of such lock mechanism as well as to reduce its manufacturing cost. The reliability of operation is further generally associated with the working arrangement between individual components.

U.S. Pat. No. 6,139,073 teaches one type of such lock mechanism for selectively locking and unlocking a single sliding door of the passenger vehicle. The lock mechanism has a base member for attachment to the passenger vehicle and a lock cam having a slot formed therein for engaging a lock mechanism element attached to the door. A pivot is connected to the base member and to the lock cam to provide a rotary connection of the lock cam to such base member.

A power lock actuator is attached to the base member and includes a linearly moveable actuator portion for engaging the lock cam for preventing unwanted rotation of the lock cam to lock the door. Such movable actuator portion is guided by a plurality of rollers to maintain alignment during operation. The actuator also has an energized actuator portion for withdrawing the moveable actuator portion from engagement with the lock cam to release the lock cam and unlock the door. The energized actuator portion is connected to a control system of the transit vehicle door.

The lock mechanism further includes a manual release operable by a person. The manual release is mounted to engage the moveable actuator portion to move it from engagement with the lock cam enabling release thereof and hence enabling manual unlocking and subsequent opening of the sliding door.

The lock mechanism additionally includes a sprag member engageable with the manual release and a biasing means connected to the sprag for biasing the sprag into engagement with the lock cam after the manual release has been used to prevent unwanted locking of such sliding door requiring reset of the sprag before the sliding door can be locked. A plurality of limit switches is associated with the movable actuator portion and the sprag for providing status signals to the control system of the passenger vehicle during lock mechanism operation.

It has been found that, for providing guidance of the movable actuator portion during locking and unlocking phases, such movable actuator portion must be machined to a very close tolerance and such plurality of guiding rollers must be adjusted to yet another set of very close tolerances during lock mechanism assembly to prevent unwanted friction and binding between actuator portion and lock cam during operation.

It has also been found that incorporation of such plurality of rollers, additional machining and adjustment requirements excessively increased lock mechanism cost. Additionally, it has been found that the sprag biasing means are subjected to high stresses due to spatial limitations within passenger vehicle structure and resulting configuration of the base member.

It is, therefore, desirable to provide an improved lock mechanism arrangement overcoming the aforementioned disadvantages and meeting the original spatial envelope constraints.

The lock mechanism taught by U.S. Pat. No. 6,139,073 is suitable only for locking the single sliding door of the passenger vehicle driven by a dedicated door drive mechanism even when such passenger vehicle has a pair of doors disposed in a door portal aperture for passenger ingress and egress. Such application is generally known as an independent door operation mode. Since a wide variety of passenger vehicles utilize a single door drive mechanism for driving the pair of doors, in what is generally known as a bi-parting door operation mode, it is desirable to utilize a single lock mechanism for locking such pair of bi-parting doors to reduce overall implementation costs.

SUMMARY OF THE INVENTION

In a first aspect, the present invention teaches a lock mechanism for selectively locking a door on a passenger vehicle in a locked position and for unlocking the door from such locked position. The door being selectively driven between an open and a closed position by a door drive which has a connection with a door control system disposed within the passenger vehicle. The lock mechanism includes a base member stationary attached to a structure of the passenger vehicle and has a pair of pivot means connected thereto. A lock cam is attached to the first pivot means for pivotal connection to the base member and has an aperture formed therein for slideably engaging a locking element attached to the door and outwardly extending toward the aperture. The locking element engages the aperture when the door is moving into the closed position causing the lock cam to move into a locked position and enabling the locking element to move into the locked position. The cam is further movable in an opposite direction for enabling movement of the locking element into an unlocked position The lock cam also has a first lock portion formed on an outer edge thereof. A lock lever is attached to the base member at the second pivot means for pivotal connection to the base member and has a second lock portion for engaging the first lock portion of the lock cam and for positively retaining the lock cam and the locking element in the locked position. The second lock portion engages an edge portion of the lock cam during movement thereof in the second direction. A power lock actuator is stationary attached to the base member. The lock actuator includes a linearly moveable portion moveably connected to the lock lever for moving thereof in a direction to disengage the second lock portion from the first lock portion and enable movement of the lock cam into the unlocked position and an actuator portion enabling movement of the moveable portion. The actuator portion has a connection with the control system for the passenger transit vehicle door. A manual release lever is positioned to directly engage the lock cam for manually releasing the lock cam from the locked position, for manually moving the lock cam into the unlocked position and for enabling independent movement of the lock cam into the unlocked position caused by a movement of the power lock actuator. An overcenter biasing means is pivotally connected to the base member and to the manual release lever for selectively biasing thereof when the lock cam is disposed in one of the locked and the unlocked position. A pin member is attached to the manual release lever and engageable with a curved slot disposed within the lock cam and at least partially aligned curved slot disposed within the base member for enabling the lock cam to move the manual release lever therewith during movement from the unlocked position into the locked position. A pair of sensors engage the lock lever for providing a first positional signal associated with a position of the lock lever and a sensor engages the manual release lever for providing a second positional signal associated with a position of the manual release.

In a second aspect, the present invention provides a lock mechanism for selectively locking and unlocking a pair of doors disposed in tandem within a door aperture of the passenger vehicle and moving in opposite directions for covering and uncovering the door aperture. The lock mechanism includes two pairs of lock cam and lock lever combinations, with each combination associated with its respective door. The lock levers have linkage connection to a common member, which is pivotally attached to the stationary base member. A power lock actuator is attached to the common member. The lock mechanism also includes a pair of adjacent levers pivotally connected to the stationary base member at a common pivot and provided with flexible cables for remote unlocking purposes. During such remote unlocking, pivoting of either lever will pivot the common member thus displacing the lock cams from the locked positions.

In a third aspect, the present invention provides a lock mechanism having a lock cam disposed for linear movement to selectively lock and unlock a door of a passenger vehicle. The lock cam and the stationary base member incorporate complimentary guiding portions for guiding linear movement of the lock cam. A lock lever may be provided for maintaining the lock cam in the unlocked position and is resetable either by the movement of the locking element or by the action of an independent actuator. The lock mechanism may be further adapted to selectively lock and unlock a pair of doors with a single lock actuator by employing a linkage disposed intermediate thereof and such pair of lock cams.

OBJECTS OF THE INVENTION

It is, therefore, one of the primary objects of the present invention to provide an improved lock mechanism for a passenger vehicle which selectively locks and unlocks a door of the passenger vehicle.

It is another object of the present invention to provide an improved lock mechanism for a passenger vehicle which has a manual release means for manual unlocking of the door.

It is yet another object of the present invention to provide an improved lock mechanism for a passenger transit vehicle which increases reliability of operation.

It is a further object of the present invention to provide an improved lock mechanism for a passenger vehicle which utilizes less moving components.

It is additional object of the present invention to provide an improved lock mechanism for a passenger vehicle which selectively locks and unlocks a pair of bi-parting doors.

It is yet an additional object of the present invention to provide an improved lock mechanism for a passenger vehicle which incorporates a linearly movable locking means.

In addition to the various objects and advantages of the present invention which have been generally described above, there will be various other objects and advantages of the invention that will become more readily apparent to those persons who are skilled in the relevant art from the following more detailed description of the invention, particularly, when the detailed description is taken in conjunction with the attached drawing figures and with the appended claims.

Figure 1:
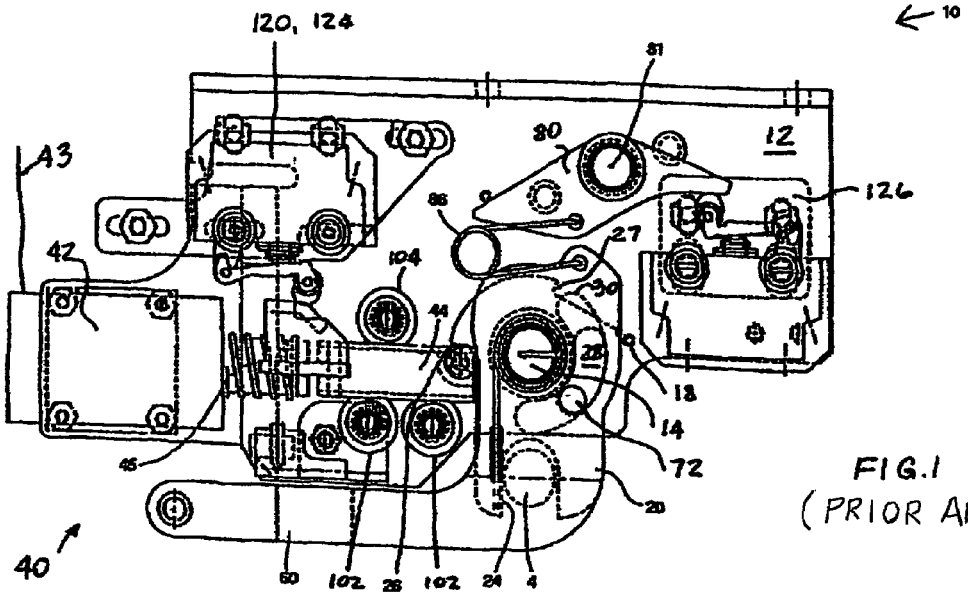
FIG.1 (PRIOR ART)
FIG. 1 is a plan view of a prior art lock mechanism particularly showing the lock cam engaging the locking element on the door as the door is in a locked position.

DESCRIPTION OF THE PRESENTLY PREFERRED AND VARIOUS ALTERNATIVE EMBODIMENTS OF THE INVENTION

Before describing the invention in detail, the reader is advised that, for the sake of clarity and understanding, identical components having identical functions have been marked where possible with the same reference numerals in each of the Figures provided in this document.

The following background information is provided to assist the reader in understanding the environment in which the invention will typically be used. The terms used herein are not intended to be limited to any particular narrow interpretation unless specifically stated otherwise in this document.

Figure 2:
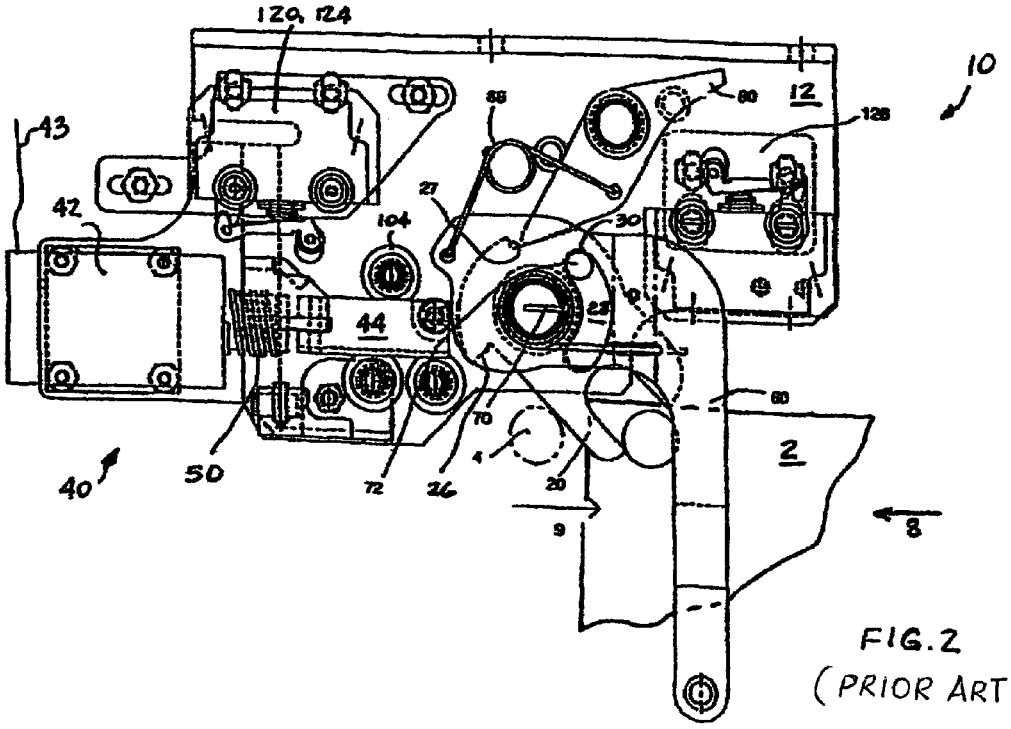
FIG.2 (PRIOR ART)
FIG. 2 is a plan view of the prior art lock mechanism illustrated in FIG. 1 showing a manual release lever in a fully rotated position enabling manual unlocking of the door.

In reference to FIGS. 1 and 2 there is shown a prior art lock mechanism, generally designated 10, disclosed in U.S. Pat. No. 6,139,073. The teaching of U.S. Pat. No. 6,139,073 is incorporated into this document by reference thereto. The lock mechanism 10 includes a base member 12 attached to a transit vehicle (not shown) and a lock cam 20 pivotally attached to such base member 12 at a pivot 14 thereof. Such lock cam 20 has a slot 24 for engaging a locking element, such as lock pin 4, attached to a door 2 of the passenger vehicle which is not shown but well known in the art.

A lock actuator, generally designated 40, is attached to the base member 12 and includes a moveable actuator portion 50 adapted for linear motion in order to engage the lock cam 20 to prevent rotation thereof after engagement with the lock pin 4 in a locked position. A torsion spring 70 biases the lock cam 20 against a lock cam stop 18 to position such lock cam 20 in an unlocked position.

Specifically, the moveable actuator portion 50 employs a lock bar 44, which engages a lock step 26 on such lock cam 20 in order to prevent rotation of the lock cam 20 when the door 2 is locked. The lock actuator 40 also includes an energized actuator portion 42 for withdrawing the moveable actuator portion 50 from engagement with the lock cam 20 to release the lock cam 20 and unlock the door 2.

The energized actuator portion 42 is an electrical solenoid. The energized actuator portion 42 includes an electrical control connection 43 for connection with a control system (not shown) for the passenger vehicle door 2.

At the end of the door 2 movement in a door closing direction, as indicated by an arrow 8 in FIG. 2, the lock pin 4 engages the slot 24 causing the rotation of the lock cam 20 in the clockwise direction and further causing the lock bar 44, which is biased toward the lock cam 20 by a bias spring 45, to engage the lock step 26 of the lock cam 24 enabling positive locking of the pin 4 and, more particularly, enabling positive locking of the door 2.

To unlock the door 2, the energized actuator portion 42 causes withdrawal of the lock bar 44 from engagement with such lock cam 20. Lock cam 20 is then free to rotate and permits the lock pin 4 to be moved in the door opening direction, as indicated by an arrow 9 in FIG. 2, from the locked position to the unlocked position.

The manual release lever 60 is rotatably mounted at a pivot 14, above lock cam 20 as shown in FIGS. 1-2 and 14-16, and operable to engage the moveable actuator portion 50 to move the lock bar 44 from engagement with lock cam 20 to release the lock cam 20 and hence manually unlock door 2. Manual release lever 60 is used to unlock door 2 when such energized actuator portion 42 is unavailable for withdrawing such moveable actuator portion 50 from engagement with lock cam 20. Manual release lever 60 is normally in a position in which the manual release lever 60 does not engage such lock bar 44, as best shown in FIG. 1.

A sprag 80 is mounted at a pivot 81 and serves to retain the lock cam 20 in the unlocked position after manual unlocking using the manual release lever 60. The sprag 80 is connected to the manual release lever 60 by a sprag spring 86. When the manual release lever 60 in its normal position, as shown in FIG. 1, the sprag spring 86 biases the sprag 80 to its normal position.

Rotation of the manual release lever in a counter-clockwise direction, best shown in FIG. 2, causes sprag 80 to pivot about its pivot 81 and engage a step portion 27 of the lock cam 20 holding it in the unlocked position. A sprag sensor 126 indicates the position of such sprag 80 and further indicates to the door control system (not shown) that the manual release lever 60 has been used. Such use of the sprag 80 prevents unwanted closing and locking of the door 2 prior to reset of the manual release lever 60.

The manual release lever 60 has a lock engaging portion, such as a pin 72 which engages one end 30 of the arcuate slot 28 formed in the lock cam 20 and rotates the lock cam 20 from the locked position in FIG. 1 to the unlocked position in FIG. 2.

Figure 6:
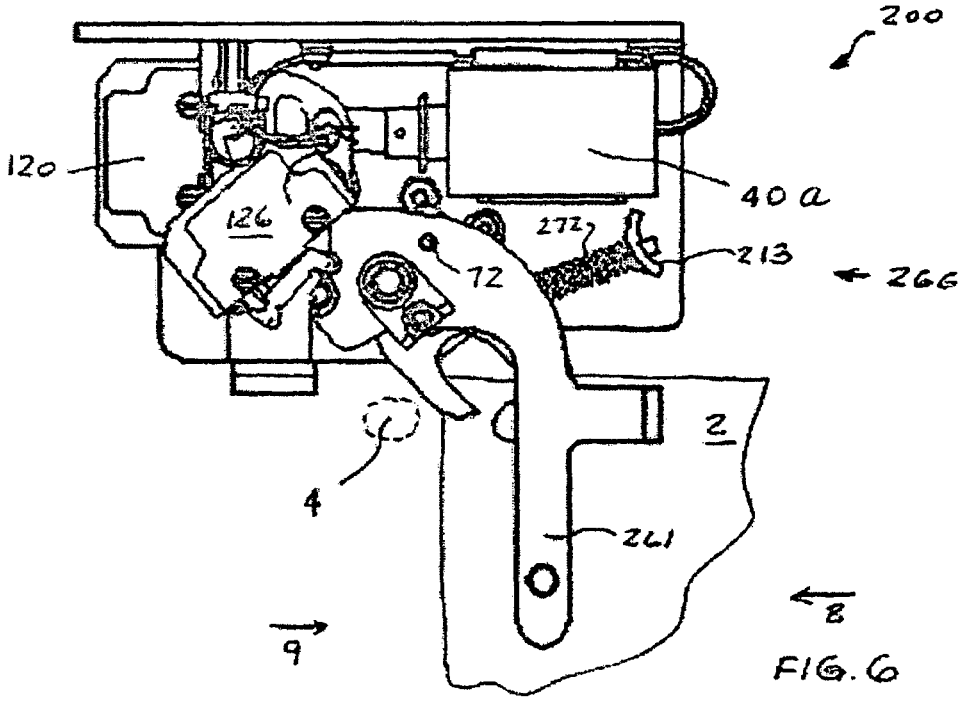
FIG. 6 is a plan view of the lock mechanism of the present invention particularly showing the manual release lever in a fully rotated position enabling manual unlocking of the door.
Figure 7:
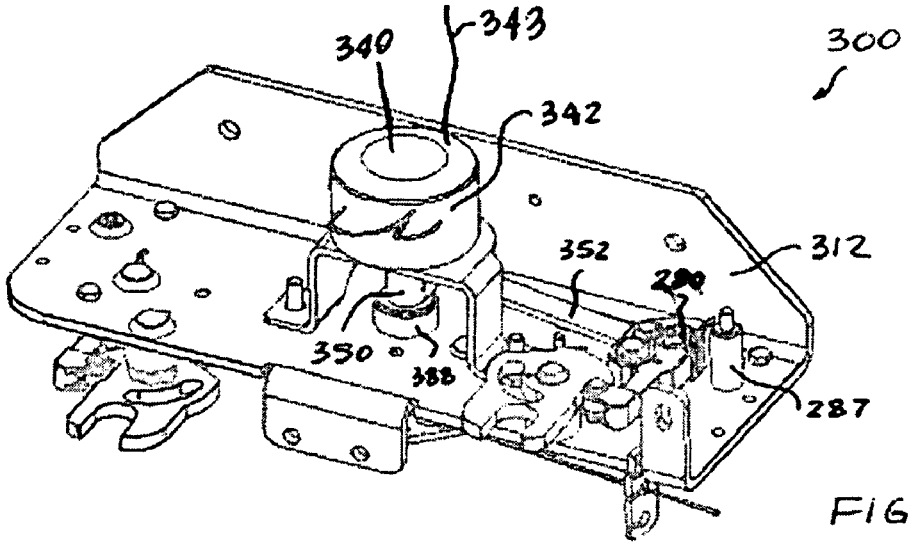
FIG. 7 is a perspective view of another embodiment of the lock mechanism of the present invention, particularly showing a pair of lock cams for engaging a pair of door locking elements.
Figure 8:
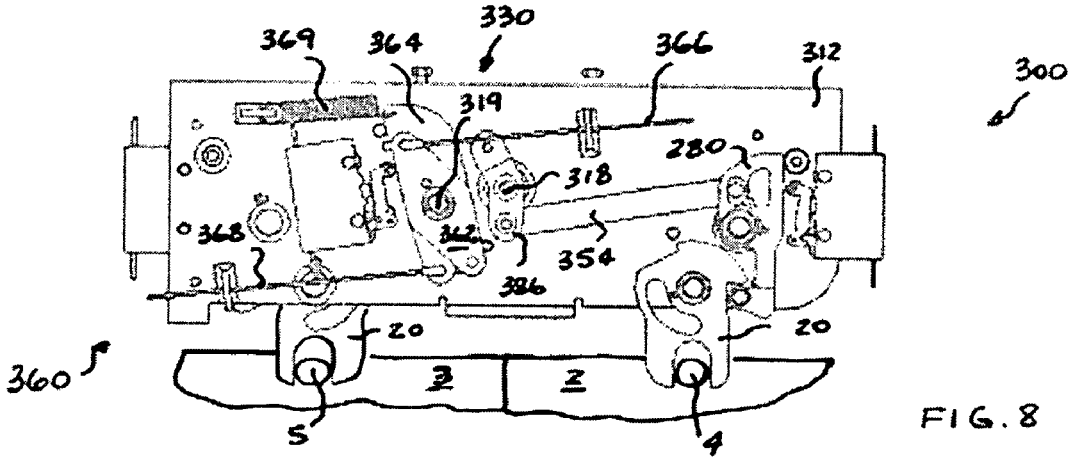
FIG. 8 is a plan view of the lock mechanism of FIG. 7 particuarly showing the lock mechanism components in a position when doors are locked.
Figure 14:
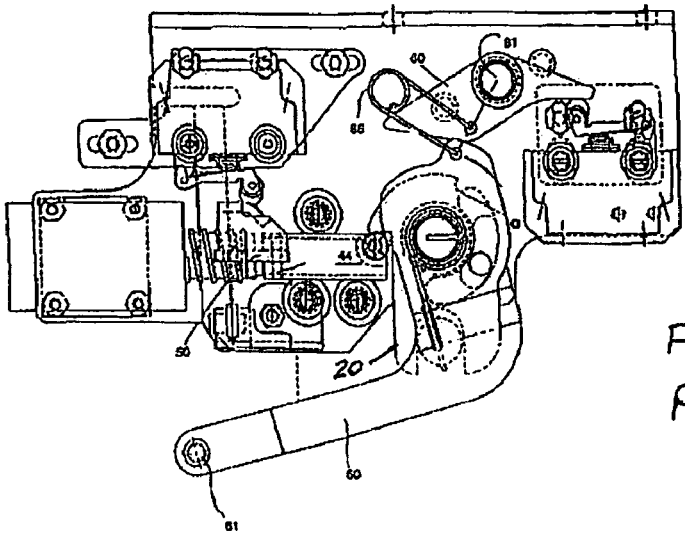
FIG. 14 PRIOR ART
FIG. 14 is a plan view of a prior art lock mechanism particularly showing a manual release lever which is partially rotated into a first intermediate position initiating disengagement of the lock step roller from the notch in the lock cam.
Figure 15:
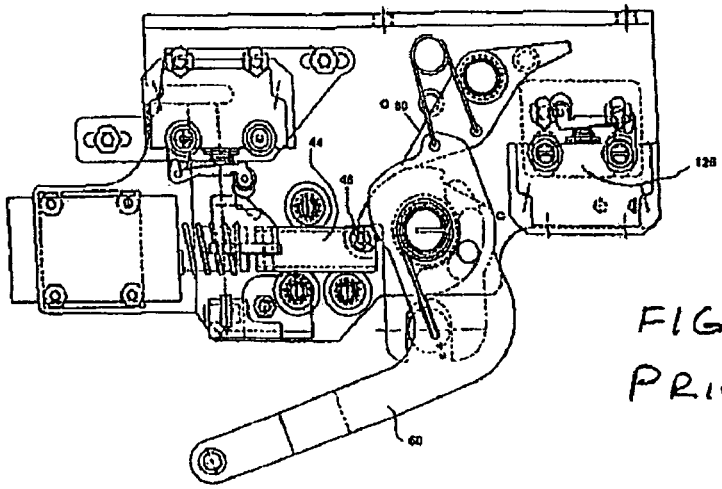
FIG. 15 PRIOR ART
FIG. 15 is a plan view of a prior art lock mechanism particularly showing the manual release lever which is rotated into a second intermediate position advancing disengagement of the lock bar roller from the lock step in the lock cam.
Figure 16:
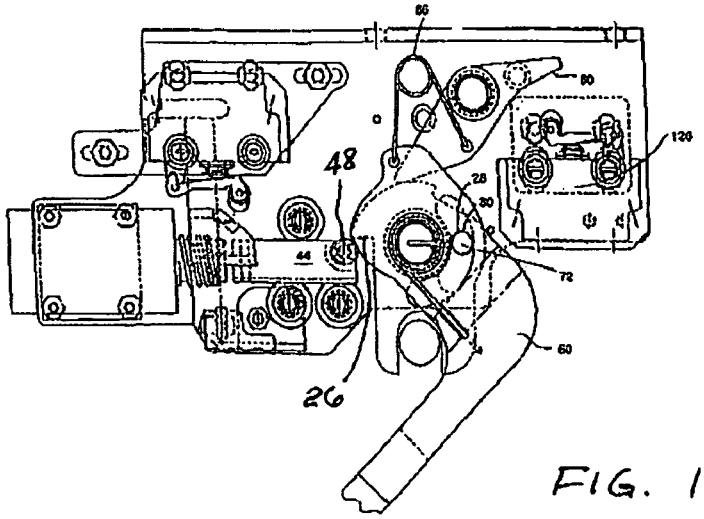
FIG. 16 PRIOR ART
FIG. 16 is a plan view of a prior art lock mechanism particularly showing the manual release lever rotated into a third intermediate position wherein the lock bar roller is fully disengaged from the lock, step in the lock cam.

Sequential rotational movement of the manual release lever 60 from its normal position in FIG. 1 to its fully rotated position in FIG. 2 in order to unlock the door 2 is best illustrated in FIGS. 14-16 which are labeled as "Prior Art" and which are substantially identical to FIGS. 6-8, respectively, of the incorporated-by-reference U.S. Pat. No. 6,139,073.

FIG. 14 illustrates the manual release lever 60 which is partially rotated in a counter-clockwise direction into a first intermediate position wherein an arcuate portion thereof engages, in the most preferred embodiment, the outer surface of the lock bar roller 48, extending above the lock cam 20, thus initiating its disengagement from the lock step 26 in the lock cam 20 by moving the lock bar roller 48 and the lock bar 44 toward the actuator 42.

In FIG. 15, the manual release lever 60 is rotated into a second intermediate position further disengaging the lock bar roller 48 and the lock bar 44 from the lock step 26.

And finally, in FIG. 16, the manual release lever 60 is rotated into a third intermediate position wherein the lock bar roller 48 and lock bar 44 are fully disengaged from the lock step 26 enabling rotation of the lock cam 20 into the unlocked position, shown in FIG. 2, by way of the pin 72 engaging the end 30 of the arcuate slot 28 formed in the lock cam 20 and by way of a continuing rotation of the manual release lever 60 into the unlocked position of FIG. 2.

To enhance reliability of operation, a pair of fixed guide rollers 102 and a moveable guide roller 104 engage the lock bar 44. The moveable guide roller 104 is adjustably biased against the lock bar 44 for positive engagement therewith.

A first actuator sensor 120 and a second actuator sensor 124 disposed in tandem and connected to the door control system (not shown) independently provide a pair of signals indicating the position of the moveable actuator portion 50.

The reader's attention is now directed to a lock mechanism of one embodiment of the present invention, generally designated 200, which is shown in FIGS. 3-6.

In this embodiment, the present invention overcomes the disadvantages of the incorporated-by-reference U.S. Pat. No. 6,139,073 by employing the prior art lock cam 20, but modifying the movable portion 50 (now 50*a*) of the lock actuator 40 (now 40*a*), replacing the prior art sprag 80 and the spring 86 with a new lock lever 280, coupling the movable portion 50*a* directly to the lock lever 280 thus eliminating the lock bar 44 with fixed and guiding rollers 102 and 104 respectively, and replacing the prior art manual release lever 60 with a new manual release lever 260.

Figure 3:
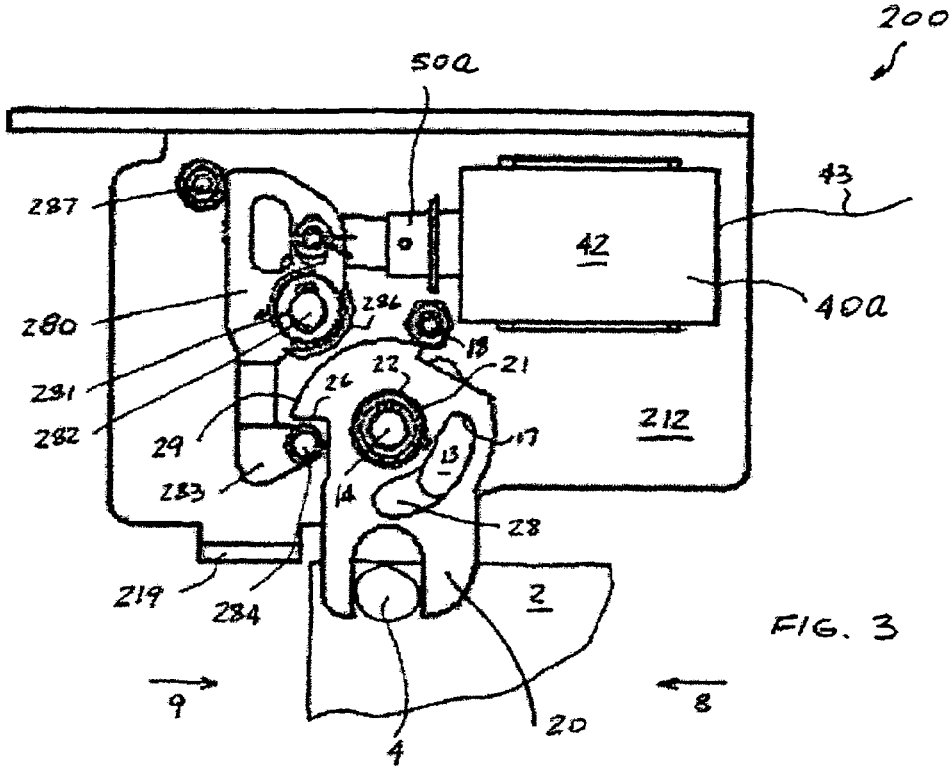
FIG. 3 is a plan view of a lock mechanism of a first embodiment of the present invention, particularly showing the lock cam engaging the locking element on the door in a locked position.
Figure 4:
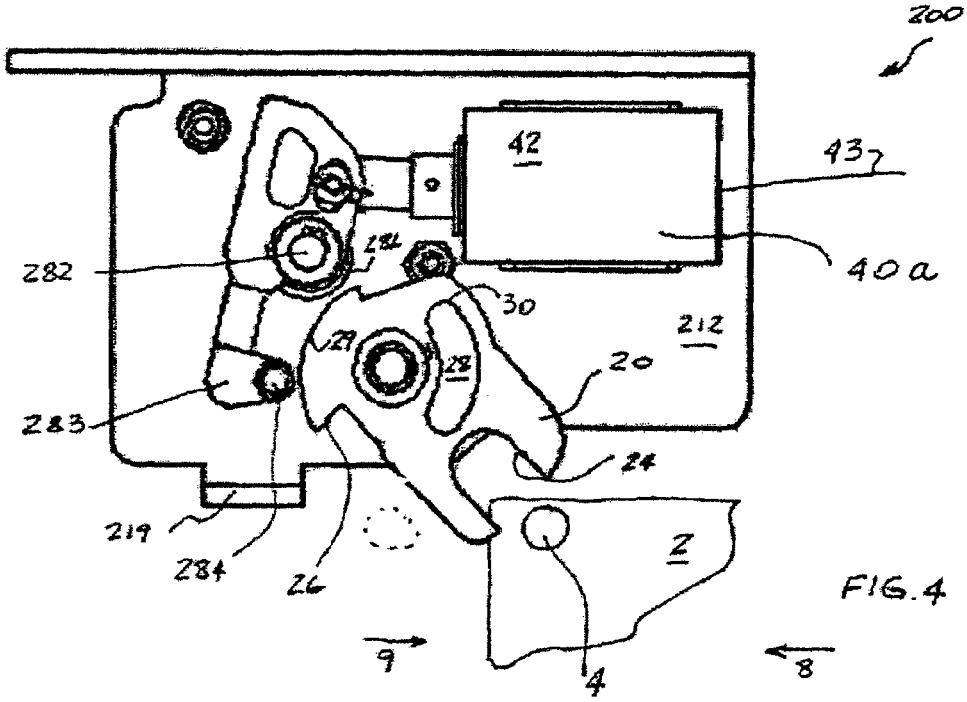
FIG. 4 is a a plan view of the lock mechanism of the present invention of FIG. 3, particularly showing the lock cam and the locking element in an unlocked position.

In particular reference to FIG. 3, a first essential element of the present invention is the lock cam 20 movably connected to a stationary structure, preferably a base member 212 which is rigidly attached to the passenger vehicle structure (not shown). In the preferred embodiment, the lock cam 20 is adapted for pivotal movement within the lock mechanism 200 by incorporating a pivot aperture 21 for engagement with a first pivot 14 rigidly attached to such base member 212 and outwardly extending from a surface thereof.

Alternatively, such first pivot 14 may be of a well known pin extending through such pivot aperture 21 and an aligned aperture (not shown) in the base member 212 and retained from axial movement thereabout or a well known shoulder screw engaging a threaded aperture (not shown) within the base member 212. Such lock cam 20 has the lock aperture 24 for slideably engaging the lock element, preferably lock pin 4, rigidly attached to a door 2. It will be appreciated that such lock cam 20 is pivotally movable between a first position being a locked position positively retaining the lock pin 4 and, more importantly, preventing the door 2 from moving in an opening direction and a second position being an unlocked position enabling movement of the lock pin 4 and, more importantly, enabling movement of the door 2 in such opening direction.

A second essential element of the present invention is a means 280 for biasing the lock cam 20 in such locked position. In the preferred embodiment, such means 280 is a lock lever movably connected to a stationary structure, preferably a base member 212. Preferably, the lock lever 280 is adapted for pivotal movement within the lock mechanism 200 by incorporating a pivot aperture 281 for pivotal engagement with a second pivot 282 rigidly attached to base member 212 and outwardly extending from a surface thereof.

Alternatively, such second pivot 282 may be a pin extending through such pivot aperture 281 and an aligned aperture (not shown) in the base member 212 and retained from axial movement thereabout or a shoulder screw engaging a threaded aperture (not shown) within the base member 212. Such lock lever 280 has a locking portion 283 biased for engagement with a lock step 26 of the lock cam 20 upon engagement thereof with the lock pin 4 in the locked position.

A second bias means 286 disposed about such second pivot 281 may be provided for biasing the locking portion 283 with the lock step 26 to enforce positive engagement therebetween. Preferably, such bias means 286 is a spring means and, more preferably, such bias means 286 is a torsion spring. To reduce frictional forces during engagement and disengagement of the lock lever 280 with the lock cam 20, the locking portion 283 of the lock lever 280 is adapted with a rolling element 284 pivotally attached thereto and engaging such lock step 26.

Accordingly, as well known from the prior art U.S. Pat. No. 6,139,073, such rolling element 284, extends above the lock cam 20 and the arcuate portion of the manual release lever 260 will preferably engage such rolling element 284, thus moving it from engagement with the lock step 26 of the lock cam 20.

A stop means 287 may be provided for limiting the rotation of the locking lever 280 when the door 2 is in a locked position.

The final essential element of the present invention is the means 40*a* for enabling movement of the lock cam 20 from the locked position to the unlocked position during normal operation. In the preferred embodiment, such means 40*a* is the lock actuator 40*a* rigidly attached to a stationary structure, preferably the base member 212. Such lock actuator 40*a* includes a moveable portion 50*a* connected to the lock lever 280 and adapted for linear movement within the lock actuator 40*a* in order to disengage the lock lever 280 from the lock step 26 of the lock cam 20. The lock actuator 40*a* further includes an actuator portion 42 which is energized for withdrawing the moveable portion 50*a*, thus enabling disengagement of the lock lever 280 from the lock step 26 of the lock cam 20 and, more importantly, enabling movement of the lock cam 20 into the unlocked position.

Preferably, the lock actuator 40*a* is a linear electrical solenoid. The solenoid 40*a* will further include an electrical control connection 43 for connecting the actuator portion 42 with a control system (not shown) for the transit vehicle door 2.

Alternatively, a pneumatic or a hydraulic lock actuator 40*a* may be used to disengage the lock lever 280 from the lock step 26 of the lock cam 20.

In applications requiring a positive retention of the lock cam 20 in the unlocked position, a biasing means 22, preferably a torsion spring 22, is disposed about the first pivot 14 for biasing the lock cam 20 against a first lock cam stop, preferably a pin 18.

To unlock the door 2 in a normal operation, the lock actuator 40*a* is momentarily energized enabling the actuator portion 42 to withdraw the moveable portion 50*a* causing the lock lever 280 to pivot and disengage the lock cam 20. Subsequent movement of the door 2 in the opening direction 9 enabled by the door drive means, which is not shown but well known in the art, rotates the cam 20 thus enabling the lock pin 4 to disengage the lock aperture 24. The rotation of the lock cam 20 is further aided by the bias spring 22 and is terminated upon engagement of the lock cam 20 with the stop pin 18. The locking portion 282 of the lock lever 280 moves along an edge 29 of the lock cam 20 upon disengagement from the lock step 26 and abuts such edge 29 in such unlocked position biased by the bias spring 286.

To lock door 2 in a normal operation, the door drive means (not shown) moves door 2 in the closing direction 8 causing engagement of lock pin 4 with lock aperture 24. Subsequent door movement in the closing direction 8 causes slidable movement of the lock pin 4 within the lock aperture 24 enabling the lock cam 20 to overcome biasing force from the biasing means 22 and rotate into the locked position as shown in FIG. 3. During rotation of the lock cam 20, locking portion 283 of the locking lever 280 moves along the edge 29 of the lock cam 20 and re-engages the lock step 26 to positively retain such lock cam 20 in the locked position.

Those skilled in the art will readily understand that pivotal cooperation between the lock cam 20 and the lock lever 280 in combination with movable cooperation of the lock lever 280 with the movable portion 50*a* of the lock actuator 40*a* during the unlocking of the door 2 eliminates forces acting onto such lock actuator 40*a* during such door 2 being in the locked position, particularly during acceleration and deceleration of the transit vehicle (not shown). Thus, the fixed and guiding rollers 102 and 104 respectively of the prior art lock mechanism 10 are no longer required to guide the movement of the movable portion 50*a*.

Figure 5:
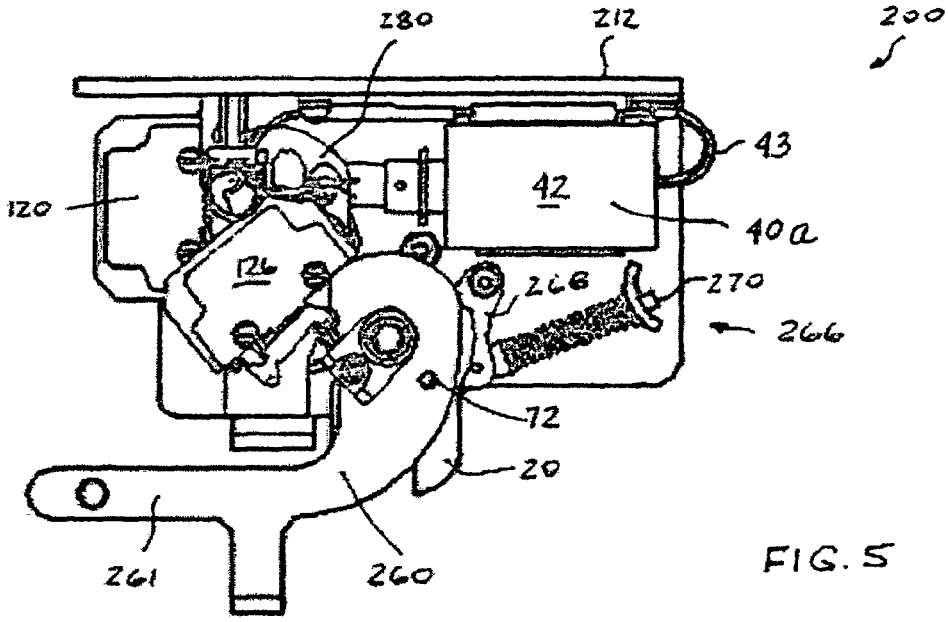
FIG. 5 is a plan view of the lock mechanism of the present invention particularly showing a manual release lever in a normal position enabling locking of the door.

At least one sensing means 120, best shown in FIGS. 5 and 6, may be adapted for cooperation with the lock cam 20, and preferably with the lock lever 280 for providing an electrical signal to the door control system (not shown) indicating the positional status of the lock cam 20 and, more particularly, indicating the status of the lock mechanism 200. Preferably, such at least one sensing means 120 is activated with the lock cam 20 being disposed in the locked position and is deactivated when the lock cam 20 and the lock lever 280 rotate during unlocking of the door 2. The at least one sensing means 120 may be either a solid state limit switch having a lever portion thereof engaging the lock lever 280 or an electronic proximity sensor capable of detecting at least a portion of such lock lever 280 at a predetermined distance. Preferably, such at least one sensing means 120 is a solid state limit switch 120.

Preferably, a predetermined plurality, such as a pair, of sensing means 120 is adapted for providing independent and redundant electrical signals to the door control system (not shown). It is further preferred that such pair of sensing means 120 is mounted in tandem.

To prevent rotation of the lock cam 20 past the locked position, the lock mechanism 200 may be adapted with a second lock cam stop which can be a second stop pin 18 but preferably is a flange 219 formed within the base member 212. The presence of such flange 219 will be beneficial when the door 2 is not adjusted properly during installation and is subjected to overtravel in the closing direction 8. It will be appreciated that rotation of the lock cam 20 past the locked position may deactivate the at least one sensing means 120 thus providing a false status signal to the door control system (not shown) indicating the door 2 is unlocked.

Now, in particular reference to FIGS. 5 and 6, a manual release means, such as lever 260, of the first embodiment is directly connected to the lock mechanism 200 at the first pivot means 14 and is operable to directly engage the lock cam 20 for rotation thereof into the unlocked position to unlock door 2. Manual release lever 260 is used to unlock the door 2 in the event that such actuator portion 42 is unavailable for withdrawing such actuator portion 50*a* from engagement with such lock lever 280. It is preferred that such manual release lever 260 has a handle 261 to facilitate use thereof by a passenger.

The manual release lever 260 has a lock engaging portion, which preferably is a pin 72 engaging one end 30 of the arcuate slot 28 formed in the lock cam 20 when such manual release lever 60 is in the locked position shown in FIGS. 3 and 5. Upon rotation of the manual release lever 260 in a direction to unlock the door 2, the pin 72 rotates the lock cam 20 from the substantially locked position to the unlocked position, as best shown in FIG. 6.

In this position, the lock lever 280 deactivates the at least one sensing means 120 and, more importantly, discontinues the electrical signal to the door control system (not shown) now indicating that the door 2 is unlocked.

It will be appreciated that operation of the manual release lever 260 is substantially identical to the operation of the prior art manual release lever 60, shown in FIGS. 14-16 except that arcuate portion of the manual release lever 260 will engage either locking portion 283 or the rolling element 284 pivotally moving it from engagement with the lock step 26 of the lock cam 20 due to rotation of the lock lever 280.

The rotation of manual release lever 260 causes lock pin 4 and door 2 to be moved a small distance in the opening direction 9. This is so that a person operating the manual release lever 260 can see that unlocking has occurred and obtain a grip on the door 2 in order to open it. When such manual release lever 260 is in the position as shown in FIG. 6, pin 72 on the manual release lever 260 encounters end 17 of the arcuate slot 13 in the base member 212, as best shown in FIG. 1. This prevents further motion of such manual release lever 260.

The manual release lever 260 is positively retained in either the locked or the unlocked position by a biasing means, generally designated 266, which in a presently preferred embodiment is a toggle assembly that acts as an overcenter device. It includes a toggle cam 268 pivotally connected to the base member 212 at one end and pivotally connected to the toggle lever 270 at a distal end. The other end of the toggle lever 270 is pivotally connected to the toggle portion 213 of the base member 212 and has a bias spring 272 disposed thereon. Upon rotation of the manual release lever into the unlocked position the toggle lever 270 is disposed external to the line connecting the toggle portion 213 and the first pivot 14 thus forming an overcenter condition.

To close the door 2 which has been manually unlocked, the manual release lever 260 shall be manually reset into an original position shown in FIG. 3. In situations, when such manual release lever 260 was not reset, the rotation of the lock cam 20 will cause the toggle cam 268 to apply a force onto the pin 72 and rotate the manual release lever 260 into such original position.

It will be appreciated that utilization of the toggle assembly 266 is advantageous over the sprag 80 and sprag biasing means of the prior art lock mechanism 10 in maintaining and resetting the manual release lever 260.

At least one sensing means 126, best seen in FIGS. 5 and 6, is adapted for cooperation with the manual release lever 260 and for providing an electrical signal to the door control system (not shown) indicating the positional status of the manual release lever 260. Preferably, such at least one sensing means 126 is deactivated with the door 2 being in the locked position and is activated when the manual release lever 260 rotates during unlocking of the door 2. The sensing means 126 may be either a solid state limit switch having a lever portion thereof engaging the manual release lever 260 or an electronic proximity sensor capable of detecting at least a portion of such manual release lever 260 at a predetermined distance. Preferably, such at least one sensing means 126 is a solid state limit switch 126.

Figure 9:
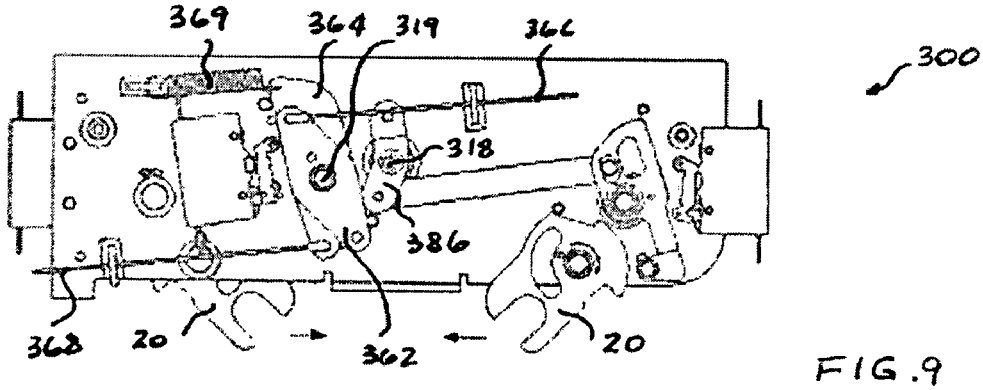
FIG. 9 is a plan view of the lock mechanism of FIG. 7 particuarly showing the lock mechanism components in a position when doors are unlocked.

Now, turning attention to FIGS. 7-9, there is shown another embodiment of the present invention containing a lock mechanism, generally designated 300, for locking the sliding door 2 and, preferably, for locking a pair of sliding doors 2 and 3 disposed in tandem within a door aperture (not shown) of the passenger vehicle (not shown) and driven in opposite opening and closing directions to cover and uncover such door aperture (not shown) by either a common door drive (not shown) or a pair of such door drives (not shown). The second door 3 contains its own lock pin 5 attached thereto.

The lock mechanism 300 includes a first lock cam 20 and a first lock lever 280 pivotally attached to a base member 312 according to the embodiment disclosed supra. A second lock cam 20 and a second lock lever 280 are pivotally attached to the base member 312 according to the embodiment disclosed supra, except that the second lock cam 20 and the second lock lever 280 are adapted for rotation in opposite directions in order to lock and unlock the second door 3.

A means, generally designated 330, for enabling movement of the pair of lock cams 20 from the locked position to the unlocked position includes a first link 352 movably attached to the first lock lever 280 and a second link 354 movably attached to the second lock lever 280. Both links 352 and 354 are pivotally connected to opposite ends of a third link 386 which has a shaft portion 388 for pivotal attachment to the base member 312 at a pivot 318 thereof, such that pivoting of the third link 286 in an unlocking direction will enable pivoting of such pair of lock cams 20 in opposite directions to unlock the pair of doors 2 and 3.

Means 330 further includes a lock actuator 340 rigidly attached to the base member 312 and having a moveable portion 350 connected to the shaft portion 388 of the third link 386 and adapted for rotary movement within the lock actuator 340 in order to disengage the pair of lock levers 280 from the corresponding lock cams 20. The lock actuator 340 further includes an actuator portion 342 which is energized for rotating the moveable portion 350. Preferably, the lock actuator 340 is a rotary electrical solenoid 340. It will be appreciated that a linear solenoid 340 may be employed by connecting the moveable portion 350 thereof with the third link 386. The solenoid 340 will further include an electrical control connection 343 for connecting the actuator portion 342 with a control system (not shown) for the passenger vehicle (not shown).

A manual release mechanism, generally designated 360, for remotely unlocking the first and second doors 2 and 3 respectively includes a first lever 362 and a second lever 364 pivotally attached to the base member 312 at a pivot 319 thereof with at least the first lever 362 engaging the third link 386. A first flexible means, such as cable 366 is attached to the first lever 362 and a second flexible means, such as cable is attached to the second lever 364 such that activation of either first or second cable 364 or 366 respectively will cause rotation of the third link 386 in the unlocking direction enabling pivoting of such pair of lock cams 20 in opposite directions to unlock the pair of doors 2 and 3.

The pair of the first and second levers 362 and 364 respectively is returned to the nonactivated position by a bias spring means 369.

It will be understood that such utilizations of the first and second levers 362 and 364 respectively enables independent operation of the first and second cable 364 or 366 respectively. In applications where such independent operation is not required, both cables may be attached to the first lever 362 eliminating the need for the second lever 364.

In applications requiring a direct connection of the manual release lever (not shown) to the lock mechanism 300, such manual release lever (not shown) may be attached to such pivot 318 for engagement with the third link 386 or may be directly attached to either the first lever 362 or the second the lever 364.

Advantageously, the lock mechanism 200 shown in FIGS. 3-6 may be adapted with at least one flexible cable (not shown) attached either to the lock cam 20 or to the lock lever 280 for a remote manual release of the lock cam 20 according to the above embodiment.

It will be appreciated that embodiments of FIGS. 3-9 teach a pivotal disposition of the lock cam 20 with respect to the door 2 or a pair of doors 2 and 3 in order to lock and unlock thereof.

It will be further appreciated that such lock cam 20 may be disposed in a plane which is coplanar with the plane of the door 2 or which is generally perpendicular to the plain of the door 2 as best suitable with the embodiments of FIGS. 7-9.

Figure 10:
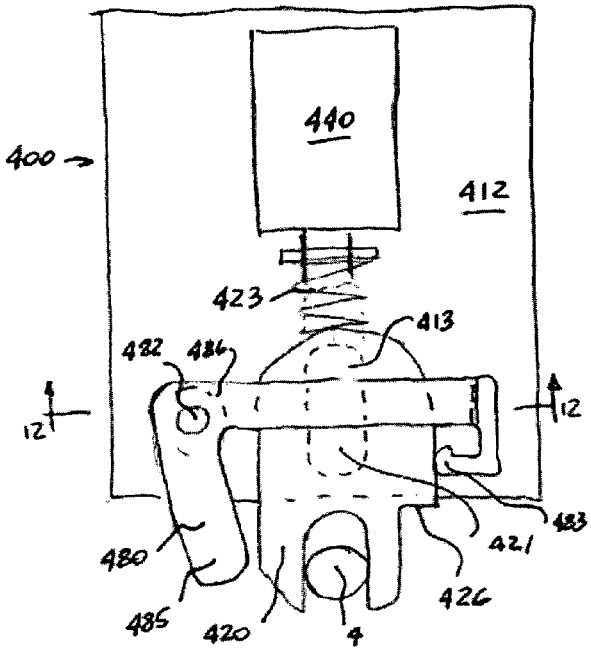
FIG. 10 is a plan view of another embodiment of the lock mechanism of the present invention, particularly showing a slideably disposed lock cam in the locked position.
Figure 11:
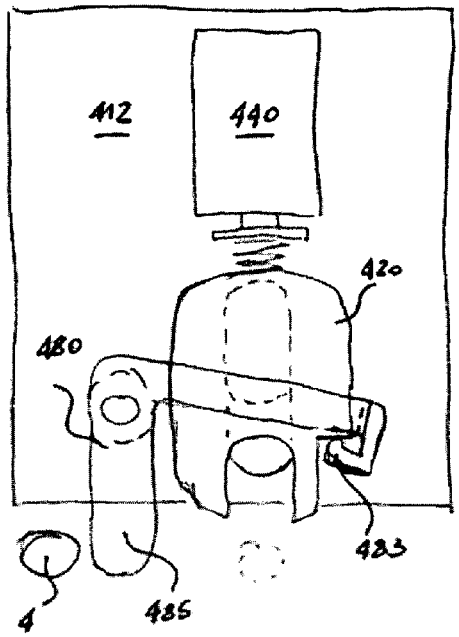
FIG. 11 is a plan view of the lock mechanism of FIG. 10, particularly showing a slideably disposed lock cam in the unlocked position.
Figure 12:
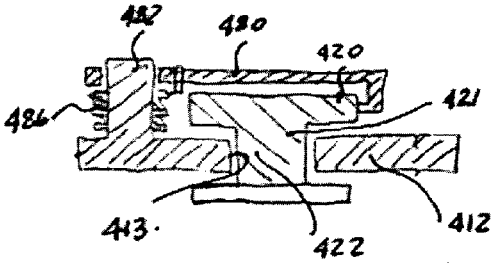
FIG. 12 is a partial cross-section view of the lock mechanism of FIG. 10 taken along lines 12-12 of FIG. 10.
Figure 13:
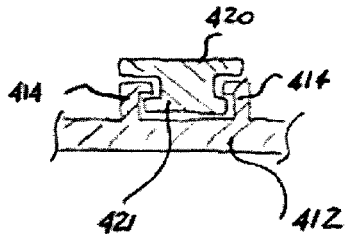
FIG. 13 is a partial cross-section view of an alternative embodiment of the lock mechanism of FIG. 10 taken along lines 12-12 of FIG. 10.

A further embodiment of the present invention containing a lock mechanism, generally designated 400, is shown in FIG. 10-13 and includes a lock cam 420 adapted for slideable connection with the base member 412 and means 421 for guiding a generally linear movement of such lock cam 420 with respect to the lock pin 4. Preferably, such guiding means 421 include a portion 422 of the lock cam 420 engaging an elongated aperture 413 of the base member 412, as best shown in FIG. 12. Alternatively, such guiding means 421 may include a pair of raised portions 414 of the base member 412, as best shown in FIG. 13.

As best shown in FIG. 10, the lock cam 420 is directly connected to the unlock actuator 440 and may be biased by a bias spring 423 in either the locked or unlocked position to terminate continuous supply of electrical power to the unlock actuator 440.

Advantageously, a vertically disposed lock cam 420 will be gravity biased toward the engagement with the lock element 4 under its own weight.

Alternatively, a lock lever 480 pivotally attached to the base member 412 at a pivot 482 may be provided with a portion 483 engaging a lock step 426 of the lock cam 420 to maintain it in the unlocked position as best shown in FIGS. 10 and 11. Such engagement of the lock lever 480 with the lock cam 420 may be further biased by a bias spring means 486.

The lock lever 480 may be provided with the reset portion 285 engageable with the lock element 4 during movement thereof in the closing direction to pivot such lock lever 480 and enable the lock cam 420 to engage the lock element 4. Alternatively, the lock lever 480 may be provided with a second unlock actuator (not shown) to disengage the lock lever 480 from the lock cam 420 and enable locking of the door 2.

Those skilled in the art will readily understand that the lock mechanism 400 may be adapted for linearly moving a pair of lock cams 420 with a single lock actuator 440 by employing a linkage member (not shown) being disposed intermediate the lock actuator 440 and the pair of lock cams 420.

While the presently preferred and various alternative embodiments of the instant invention have been described in detail above in accordance with the patent statutes, it should be recognized that various other modifications and adaptations of the invention may be made by those persons who are skilled in the relevant art without departing from either the spirit of the invention or the scope of the appended claims.

We claim:

1. In combination with a vehicle sliding door movable between a fully closed and an open position and having a locking element secured thereto and outwardly extending therefrom, a lock mechanism for selectively locking and unlocking such door, said lock mechanism comprising:

(a) a first locking means having a notch formed therein for slideably engaging and receiving such locking element, said first locking means movable in a first direction into a locked position when such door is moved toward such fully closed position and such locking element engages said notch and movable in a second direction into an unlocked position for enabling movement of such door and such locking element in a direction toward such open position, said first locking means further having a first lock portion formed on an outer edge thereof;

(b) a second locking means movably disposed about said first locking means and having a second lock portion for engaging said first lock portion and for positively retaining said first locking means and such locking element in said locked position, said second lock portion continuously engaging a portion of said outer edge of said first locking means during movement thereof between said locked and said unlocked position;

(c) an actuating means which has a linearly movable member being directly connected to said second locking means and which is momentarily actuated for moving said second locking means in a third direction to disengage said second lock portion from said first lock portion and enable movement of said first locking means in said second direction;

(d) a base member (e) a first pivot means for pivotally attaching said first locking means to said base member; and (f) a second pivot means for pivotally attaching said second locking means to said base member.

2. The lock mechanism according to claim 1, wherein said lock mechanism further includes a means for biasing said first locking means in said unlocked position and aiding in movement of said first locking means into said unlocked position and aiding in movement of said locking element toward said second position.

3. The lock mechanism according to claim 1, wherein said lock mechanism further includes a means for limiting movement of said first locking means in said first direction.

4. The lock mechanism according to claim 1, wherein said lock mechanism further includes a means for limiting movement of said first locking means in said second direction.

5. The lock mechanism according to claim 1, wherein said lock mechanism further includes a means for biasing said second locking means in a direction of said first locking means, wherein said first locking means is disposed in one of said locked and said unlocked position.

6. The lock mechanism according to claim 1, wherein said actuating means is a power actuator selected from a group consisting of an electrical, pneumatic and hydraulic power actuator.

7. The lock mechanism according to claim 1, wherein said lock mechanism further includes at least one sensing means associated with one of said first locking means, said second locking means and a combination thereof for providing a positional signal associated with a position of said first locking means.

8. The lock mechanism according to claim 1, wherein said lock mechanism further includes a means pivotally and directly engageable with said first locking means for manually releasing it from said locked position and for manually moving said first locking means into said unlocked position, said manual release means enabling independent movement of said first locking means into said unlocked position caused by a movement of said actuating means.

9. The lock mechanism according to claim 8, wherein said manual release means includes a member engageable with an aperture disposed within said first locking means and an at least partially aligned aperture disposed within a rigid attachment means for enabling said first locking means moving from said unlocked position into said locked position to move said manual release means therewith.

10. The lock mechanism according to claim 8, wherein said manual release means includes a biasing means pivotally connected to a portion of said rigid attachment means for selectively biasing said manual release means when said first locking means is disposed in one of said locked and unlocked position.

11. The lock mechanism according to claim 8, wherein said lock mechanism further includes a sensing means engageable with said manual release means for providing a positional signal associated with a position of said manual release means.

12. The lock mechanism according to claim 8, wherein said lock mechanism further includes at least one means connected to one of said first locking means and said second locking means for manually releasing said first locking means from at least one remote location.

13. A lock mechanism for selectively locking a door on a passenger vehicle in a locked position and for unlocking said door from said locked position, said door selectively driven by a door drive means in an opening and a closing direction, said door drive means having a connection with a door control system disposed within said passenger vehicle, said lock mechanism comprising:

(a) a stationary base member;

(b) a first pivot means connected to said base member;

(c) a lock cam attached to said first pivot means for pivotal connection to said base member, said lock cam having a notch formed therein for slideably engaging and receiving a locking element attached to said door and outwardly extending therefrom toward said notch, whereby said door movable in a closed direction causes said locking element to engage said notch, and whereby said lock cam movable in a first direction for enabling movement of said locking element into said locked position and movable in a second direction for enabling movement of said locking element into an unlocked position, said lock cam further having a first lock portion formed on an outer edge thereof;

(d) a second pivot means connected to said base member adjacent said first pivot means;

(e) a lock lever attached to said second pivot means for pivotal connection to said base member, said lock lever having a second lock portion disposed therein for engaging said first lock portion of said lock cam and for positively retaining said lock cam and said locking element in said locked position, said second lock portion continuously engaging a portion of said outer edge of said lock cam during movement thereof between said locked and said unlocked position;

(f) a lock actuator attached to said base member, said lock actuator including:

(i) a linearly moveable portion being directly connected to said lock lever for moving it in a direction to disengage said second lock portion from said first lock portion and enable movement of said lock cam into said unlock position, and (ii) an actuator portion which is momentarily actuated for enabling movement of said moveable portion, said actuator portion being connectable to a control system for said passenger transit vehicle door;

(g) a manual release lever engaging said lock cam for manually releasing said lock cam from said locked position and manually moving said lock cam into said unlocked position, said manual release lever enabling movement of said first locking means into said unlocked position independently from operation of said actuating means and an action of said door drive means;

(h) an overcenter biasing means pivotally connected to said base member and to said manual release lever for selectively biasing it when said lock cam is disposed in one of said locked and said unlocked position;

(i) means attached to said manual release lever and engageable with an aperture disposed within said lock cam and at least partially aligned aperture disposed within said base member for enabling said lock cam to move said manual release lever therewith during movement from said unlocked into said locked position;

(j) at least one means engageable with said lock lever for providing a first positional signal associated with a position of said lock lever; and (k) at least one means engageable with said manual release lever for providing a second positional signal associated with said manual release lever disposed in one of said first and said second position.

* * * * *